US006083562A

United States Patent [19]

Rodriguez et al.

[11] Patent Number: 6,083,562

[45] Date of Patent: Jul. 4, 2000

[54] METHODS FOR MAKING ANTISTATIC FIBERS [AND METHODS FOR MAKING THE SAME]

[75] Inventors: Edgardo Rodriguez, Pensacola; John W. Lindsay, Navarre; William E. Streetman, Pensacola, all of Fla.

[73] Assignee: Sterling Chemicals International, Inc., Houston, Tex.

[21] Appl. No.: 09/338,022

[22] Filed: Jun. 22, 1999

Related U.S. Application Data

[62] Division of application No. 08/869,081, Jun. 4, 1997, Pat. No. 5,972,499.

[51] Int. Cl.[7] ..... B05D 5/12

[52] U.S. Cl. ..... 427/393.1

[58] Field of Search ..... 472/389.9, 392, 472/393.1

[56] References Cited

U.S. PATENT DOCUMENTS

| | | | |
|---|---|---|---|
| Re. 35,278 | 6/1996 | Newman et al. | 428/265 |
| 3,415,051 | 12/1968 | Levesque et al. | 57/254 |
| 3,969,559 | 7/1976 | Boe | 428/87 |
| 4,067,948 | 1/1978 | Reinehr et al. | 264/182 |
| 4,129,677 | 12/1978 | Boe | 428/372 |
| 4,140,844 | 2/1979 | Lohwasser | 526/341 |
| 4,143,200 | 3/1979 | Radlmann et al. | 428/373 |
| 4,154,881 | 5/1979 | Hirakawa et al. | 428/92 |
| 4,163,078 | 7/1979 | Reinehr et al. | 428/373 |
| 4,180,617 | 12/1979 | Reinehr et al. | 428/398 |
| 4,207,376 | 6/1980 | Nagayasu et al. | 428/367 |
| 4,224,269 | 9/1980 | Reinehr et al. | 264/171 |
| 4,261,945 | 4/1981 | Pfeiffer et al. | 264/177 F |
| 4,278,634 | 7/1981 | Zwick et al. | 264/168 |
| 4,297,412 | 10/1981 | Achard et al. | 428/370 |
| 4,303,607 | 12/1981 | DeMaria et al. | 264/178 F |
| 4,307,054 | 12/1981 | Chion et al. | 264/171 |
| 4,308,332 | 12/1981 | Upson et al. | 430/62 |
| 4,309,479 | 1/1982 | Naruse et al. | 428/397 |
| 4,350,731 | 9/1982 | Siracusano | 428/377 |
| 4,356,134 | 10/1982 | Reinehr et al. | 264/49 |
| 4,357,379 | 11/1982 | Sloan et al. | 428/113 |
| 4,388,370 | 6/1983 | Ellis et al. | 428/368 |
| 4,394,304 | 7/1983 | Wnek | 252/520 |
| 4,401,545 | 8/1983 | Naarmann et al. | 204/291 |
| 4,419,313 | 12/1983 | Bromley et al. | 264/167 |
| 4,420,534 | 12/1983 | Matsui et al. | 428/372 |
| 4,434,530 | 3/1984 | Miessen et al. | 19/0.46 |
| 4,468,291 | 8/1984 | Naarmann et al. | 204/13 |
| 4,483,903 | 11/1984 | Reinehr et al. | 428/373 |
| 4,510,111 | 4/1985 | Sawanishi et al. | 264/177 F |
| 4,521,450 | 6/1985 | Bjorklund et al. | 427/121 |
| 4,555,811 | 12/1985 | Shimalla | 2/51 |
| 4,566,955 | 1/1986 | Naarmann | 204/59 R |
| 4,567,250 | 1/1986 | Naarmann et al. | 528/423 |
| 4,568,483 | 2/1986 | Naarmann et al. | 252/500 |
| 4,585,581 | 4/1986 | Skotheim | 252/518 |
| 4,604,427 | 8/1986 | Roberts et al. | 525/185 |

FOREIGN PATENT DOCUMENTS 3321281 12/1983 Germany .

OTHER PUBLICATIONS

G.P. Gardini; The Oxidation of Monocyclic Pyrroles; Adv. Heterocycl. Chem. 15, pp. 67–98 (1973) (and references therein).

G.B. Street, et al.; Preparation and Characterization of Neutral and Oxidized Polypyrrole Films; Mol. Cryst. Liq. Cryst., 1982, vol. 83, pp. 253–264.

Mary E. Galvin et al.; Electrically conductive polymer composites: polymerization of acetylene in polyethylene; Polymer, 1982, vol. 23, Jun., pp. 795–797; Butterworth & Co. (Publishers) Ltd.

Tamotsu Inabe et al.; Spinning Fibres and Fibre Blends of an Electrically Conductive Polymer; J. Chem. Soc., Chem. Commun., 1983, pp. 1084–1085.

Michael F. Rubner et al.; Structure–Property Relationships of Polyactylene/Polybutadiene Blends; Macromolecules, 1983 American Chemical Society, vol. 16, No. 6, pp. 870–875.

Tamotsu Inabe, et al.; Processable, Oriented, Electrically Conductive Hybrid Molecular/Macromolecular Materials; Macromolecules, 1984 American Chemical Society, vol. 17, No. 2, pp. 260–261.

Robert B. Bjorklund et al.; Some Properties of Polypyrrole–Paper Composites; Journal of Electronic Materials, vol. 13, No. 1, 1984, pp. 211–230; AIME.

Marco–A DePaoli et al.; Conductive Composites from Poly-(vinyl chloride) and Polypyrrole; J. Chem. Soc., Chem. Commun., 1984; pp. 1015–1016.

Osamu Niwa et al.; Electrochemical Polymerization of Pyrrole on Polymer–coated Electrodes; J. Chem. Soc., Chem. Commun., 1984; pp. 817–818.

A.G. MacDiarmid, et al.; Aqueous Chemistry and Electrochemistry of Polyacetylene and "Polyaniline": Application to Rechargeable Batteries, Amer. Chem. Soc. National Mtg., Polymer Preprints, 1984; pp. 248–249.

*Primary Examiner*—Erma Cameron
*Attorney, Agent, or Firm*—Tobor, Goldstein & Healey, L.L.P.

[57] ABSTRACT

A process and materials made by the process which includes a bicomponent fiber, made of a nonconductive first component, including a first fiber-forming polymer selected from the group consisting of polyethylene terephthalate, nylon 6, nylon 6,6, cellulose, polypropylene cellulose acetate, polyacrylonitrile and copolymers of polyacrylonitrile; a conductive second component, including carbon particles and a second fiber-forming polymer selected from the group consisting of polyethylene terephthalate, nylon 6, nylon 6,6, cellulose, polypropylene cellulose acetate, polyacrylonitrile and copolymers of polyacrylonitrile; and a conductive third component, including a polymer selected from the group consisting of polypyrrole and polyaniline, said polymer formed in situ and being interspersed among at least a portion of the carbon particles of the second component.

(List continued on next page.)

7 Claims, No Drawings

U.S. PATENT DOCUMENTS

| | | | |
|---|---|---|---|
| 4,610,905 | 9/1986 | von Blücher et al. | 428/90 |
| 4,617,228 | 10/1986 | Newman et al. | 428/265 |
| 4,659,529 | 4/1987 | Kobashi et al. | 264/182 |
| 4,661,389 | 4/1987 | Mudge et al. | 428/110 |
| 4,665,129 | 5/1987 | Naarmann et al. | 525/186 |
| 4,692,225 | 9/1987 | Witucki et al. | 204/59 R |
| 4,696,835 | 9/1987 | Maus et al. | 427/121 |
| 4,697,000 | 9/1987 | Witucki et al. | 528/423 |
| 4,697,001 | 9/1987 | Walker et al. | 528/423 |
| 4,707,527 | 11/1987 | Druy et al. | 525/417 |
| 4,710,400 | 12/1987 | Gardini et al. | 427/121 |
| 4,713,292 | 12/1987 | Takemura et al. | 428/373 |
| 4,743,505 | 5/1988 | Yamada et al. | 428/373 |
| 4,756,969 | 7/1988 | Takeda | 428/372 |
| 4,764,573 | 8/1988 | Myers | 526/90 |
| 4,803,096 | 2/1989 | Kuhn et al. | 427/121 |
| 4,818,458 | 4/1989 | Sugiura et al. | 264/182 |
| 4,866,107 | 9/1989 | Doxsee et al. | 523/153 |
| 4,873,142 | 10/1989 | Bach | 428/359 |
| 4,877,646 | 10/1989 | Kuhn et al. | 427/121 |
| 4,917,950 | 4/1990 | Wang | 428/373 |
| 4,942,078 | 7/1990 | Newman et al. | 428/192 |
| 4,975,317 | 12/1990 | Kuhn et al. | 428/253 |
| 4,981,718 | 1/1991 | Kuhn et al. | 427/121 |
| 4,985,304 | 1/1991 | Wang | 428/373 |
| 4,999,244 | 3/1991 | Morimoto | 428/372 |
| 4,999,245 | 3/1991 | Orino et al. | 428/374 |
| 5,030,508 | 7/1991 | Kuhn et al. | 428/253 |
| 5,068,061 | 11/1991 | Knobel et al. | 252/511 |
| 5,102,727 | 4/1992 | Pittman et al. | 428/259 |
| 5,108,829 | 4/1992 | Kuhn | 428/253 |
| 5,112,450 | 5/1992 | Jasne | 204/59 R |
| 5,130,054 | 7/1992 | Jasne | 252/500 |
| 5,162,135 | 11/1992 | Gregory et al. | 427/121 |
| 5,174,867 | 12/1992 | Naarmann et al. | 204/59 R |
| 5,206,085 | 4/1993 | Nakagawa et al. | 428/372 |
| 5,213,714 | 5/1993 | Kampf et al. | 252/500 |
| 5,225,241 | 7/1993 | Dischler | 427/121 |
| 5,256,050 | 10/1993 | Davies | 425/131.5 |
| 5,286,414 | 2/1994 | Kampf et al. | 252/500 |
| 5,292,573 | 3/1994 | Adams, Jr. et al. | 428/196 |
| 5,324,466 | 6/1994 | Orino et al. | 264/171 |
| 5,352,518 | 10/1994 | Muramoto et al. | 428/373 |
| 5,362,562 | 11/1994 | Evans et al. | 428/369 |
| 5,405,657 | 4/1995 | Bastian et al. | 427/501 |
| 5,407,699 | 4/1995 | Myers | 427/121 |
| 5,434,002 | 7/1995 | Yoon et al. | 428/357 |
| 5,458,968 | 10/1995 | Bittle et al. | 428/357 |
| 5,466,503 | 11/1995 | Dischler | 421/43 |
| 5,468,555 | 11/1995 | Lijten et al. | 428/365 |
| 5,505,889 | 4/1996 | Davies | 264/173.16 |
| 5,569,509 | 10/1996 | Dischler | 428/113 |

METHODS FOR MAKING ANTISTATIC FIBERS [AND METHODS FOR MAKING THE SAME]

CROSS REFERENCES TO RELATED APPLICATIONS

This is a divisional application of application, Ser. No. 08/869,081, now U.S. Pat. No. 5,972,499 filed Jun. 4, 1997.

BACKGROUND OF THE INVENTION

1. Field of Invention

In one broad aspect, the invention relates to fibers, preferably conductive fibers. In another broad aspect, the invention relates to a conductive polymer matrix comprising conductive particles.

2. Description of the Related Art

A variety of materials and methods have been known and used for protection against electrostatic discharge. Antistatic and conductive materials are useful for such applications. As used herein, the term "nonconductive" means material with a surface resistivity greater than $10^{11}$ Ω/square; the term "antistatic" means material with a surface resistivity between $10^4$–$10^4$ Ω/square; the term "highly conductive" means material with a surface resistivity between $10^0$–$10^4$ Ω/square; and the term "conductive" broadly means material with a surface resistivity between $10^0$–$10^{11}$ Ω/square. The use of organic polymers which are electrically conductive is well known. However, one of the limitations of the conductive organic polymer materials and methods previously utilized has been their lack of stability. The influence of environmental conditions such as temperature, humidity and air oxidation on the stability of conducting polymers is described in Munstedt, H., "Aging of Electrically Conducting Organic Materials", *Polymer*, Volume 29, Pages 296–302 (February, 1988). In particular, conventional polymer films and surface treated fibers are limited by thermal stability, resistance to chemicals and mechanical abrasion. Therefore, the art has sought materials and methods for making materials with reduced resistivity that are environmentally stable.

SUMMARY OF INVENTION

The present invention is directed generally to antistatic materials and methods for making such materials, and preferably to highly conductive materials. For example, a variety of antistatic and highly conductive fibers, fabrics and films may be made in accordance with this invention. In a broad aspect, the materials include conductive particles such as conductive carbon which may be subsequently treated with a conductive polymer phase to form an interpenetrated network. Preferably, it is contemplated that the conductive particles are in electroconductive contact with the conductive polymer and may even to some extent be in physical contact. It has been discovered that the environmental durability or stability of such conductive polymer containing materials may be dramatically improved, when they are formed to provide an interpenetrated conductive polymer phase. For instance, tow bundles of such fibers may have a resistivity of approximately $10^2$ to $10^4$ ohms per square with demonstrated environmental resistance to both heat and certain chemicals as further detailed below.

The present invention in one aspect includes a fiber having one or more nonconductive fiber-forming polymer components. Each of these fiber components includes at least one polymer, and the same polymer may be in more than one component. For example, as discussed below, a bicomponent fiber may be provided with polyacrylonitrile in both of the components. At least one of the fiber components should be conductive and include electrically conductive particles and a conductive polymer in addition to the nonconductive fiber-forming polymer component. The conductive particles should be present in at least the conductive component in an amount sufficient to lower the resistivity of this component to at least the antistatic level and preferably to the "highly conductive level." An effective amount of the conductive polymer must also be present in this component along with the conductive particles. The conductive polymer may include polypyrrole, the electrical conductive particles may include carbon, and the nonconductive fiber-forming polymer components may include polyacrylonitrile or an acrylonitrile copolymer.

The conductive fiber component may comprise from about 15 wt % to about 50 wt % electrically conductive particles and from about 50 wt % to about 85 wt % polymer. Although the particles may occupy from about 15 wt % to about 50 wt % of the conductive fiber component, they may occupy a much smaller percentage of the total fiber, e.g., as low as about 5% or in certain applications even lower.

The conductive polymer may be suffused within at least a portion of the conductive fiber component. Preferably, the suffused conductive polymer is formed in situ in the fiber. The conductive polymer may be interspersed in at least a portion of the fiber, forming an annular or concentric ring in the fiber. As used herein, the term "concentric" applies to both circular and noncircular cross-sectional fibers and is used interchangeably with "annular." The conductive polymer may also be interspersed among at least a portion of the electrically conductive particles beneath the surface of the fiber. Preferably, the conductive polymer is one having a conjugated unsaturated backbone, and more preferably is polypyrrole or polyaniline, or any polymer sharing the same general physical and conductive properties as polypyrrole or polyaniline. Polypyrrole is the most preferred conductive polymer for the present invention and is preferably incorporated into the fiber, film or other polymer matrix by in situ formation.

In another aspect, the fiber may be made of an interpenetrated polymer network with a major polymer phase including conductive particles dispersed in a nonconductive polymer, and a minor polymer phase, interpenetrated into the major phase, comprising a conductive polymer, the conductive polymer being present in an amount sufficient to lower the resistivity of the fiber.

In an additional aspect, the fiber may include at least three components, the first component being nonconductive; the second component being conductive, with an effective amount of conductive particles interspersed therein; the third component forming the minor phase of an interpenetrated polymer network, having a major phase comprising at least the second component, or both the first and second components.

Another specific embodiment of the present invention includes a multicomponent fiber, preferably a bicomponent fiber, wherein the two "components" of the "bicomponent fiber" are the fiber-forming components. The first component of the bicomponent fiber comprises a nonconductive polymer, preferably one, selected from the group consisting of polymers used to manufacture acrylic, nylon and polyester fibers. The first component also comprises a conductive polymer, preferably one, selected from the group consisting of polypyrrole and polyaniline, which polymer is preferably formed in situ and interspersed among at least a portion of the nonconductive polymer. The second component of the bicomponent fiber preferably comprises (a) the same fiber forming polymer as in the first component; (b) carbon particles; and (c) a conductive third component, which preferably includes a polymer selected from the group consisting of polypyrrole and polyaniline, which polymer is preferably formed in situ and interspersed among at least a portion of the carbon particles of the second component. The carbon particles may be present in an amount of at least about 15 wt % of the second component. Alternatively, the carbon particles may be present in an amount of from about 35 wt % to about 50 wt % of the second component. The polypyrrole may form an annular ring in and around the outer portion of both components of the fiber. Optionally, the first and second fiber-forming polymers may each comprise acrylonitrile-vinyl acetate copolymer. In another aspect, the fiber of the present invention may also include a conductive third non-fiber forming component comprising polypyrrole wherein the polypyrrole is formed by introducing pyrrole monomer to an already-formed fiber (i.e., a "base fiber") comprising the first and second components and polymerizing the polypyrrole in situ. A conductive third component of the present invention may occupy about 0.1 to about 10.0 wt % of the fiber. The bicomponent fiber may be randomly layered. Alternatively, the fiber may be a core-and-sheath bicomponent fiber, the first component forming the inner core and the second component having the carbon particles forming the outer sheath.

The fiber may be substantially circular in cross-section or it may be non-circular, e.g., tri-lobal, bean, kidney, mushroom or peanut shaped. Methods for making fibers with those different shapes are reported in the patent literature and elsewhere and will not be discussed here. The fiber may be an antistatic fiber or a conductive fiber. Preferably, a tow bundle made of the fibers of the present invention has a resistivity of less than about $10^5$ ohms per square, where resistivity of the tow bundle is measured according to standard test method AATCC 76-1995 (American Association of Textile Colorists & Chemists). More preferably, a tow bundle made of the fibers of the present invention has a resistivity from about $10^1$ to $10^4$ ohms per square.

In another aspect, the invention is directed to a method. A specific embodiment of the invention involves a method of making a conductive polymeric fiber, including the steps of forming a base antistatic fiber; contacting the base fiber with monomer for a period sufficient for the base fiber to be suffused by the monomer; and polymerizing the monomer to form a conductive polymeric fiber, wherein the base fiber includes at least one fiber-forming polymer and an effective amount of conductive particles to provide at least antistatic properties; and the resulting conductive polymeric fiber has a resistivity of less than about $10^5$ ohms per square, and preferably from about $10^1$ to $10^4$ ohms per square. The term "suffused" as used herein means, when referring to an unreacted monomer such as pyrrole, that the fiber or other formed polymeric article is at least partially impregnated with the monomer, as distinguished from a mere surface treatment, where substantially no monomer passes below the surface of the fiber or other article.

Another specific embodiment of the invention involves a method of making a conductive multicomponent polymeric fiber, at least one that has antistatic properties and preferably having highly conductive properties. The method preferably includes the steps of forming a multicomponent antistatic base fiber having at least two polymeric components, where conductive particles are dispersed in at least one of the polymeric components; contacting the multicomponent base fiber with a mixture comprising a monomer for a time sufficient to suffuse the multicomponent fiber with the monomer; and polymerizing the monomer to form a conductive multicomponent polymeric fiber, preferably having a resistivity of less than about $10^5$ ohms per square and, more preferably, about $10^1$ to $10^4$ ohms per square.

In another specific embodiment, a method of the present invention includes the steps of forming a base antistatic polymeric fiber having a conductive component which has at least about 15 wt % electrically conductive particles; contacting the formed fiber with monomers of a highly conductive polymer for a time sufficient to suffuse the monomers into the fiber; and polymerizing the monomers to form a fiber with an interpenetrating conductive polymer phase. Preferably, the fiber is contacted with the monomers in the substantial absence of a polymerization initiator. That is, the polymerization initiator is preferably added after the fiber is contacted, and preferably after the fiber is suffused (totally or partially) with unreacted monomers. In a preferred embodiment, an additional feature of the present invention includes the step of oxidatively polymerizing the monomers.

Another specific embodiment involves a method of making a low-resistivity fiber suffused with a sub-surface layer of polypyrrole. Such method may include the steps of preparing a first aqueous solution of acrylonitrile/vinyl acetate copolymer and sodium thiocyanate; preparing a second aqueous solution of acrylonitrile/vinyl acetate copolymer, sodium thiocyanate and carbon black; metering the two solutions into different sides of a static mixer system so as to form alternating layers of the two solutions across the cross-section of the flowing stream exiting the static mixer; metering the stream into a spinnerette to form smaller individual streams, which then flow into a coagulation bath of a sodium thiocyanate/water solution at 32° F. to form wet fibers; stretching the wet fibers; washing the stretched wet fibers to remove solvents; drying the wet fibers, the wet fibers not being under tension; steam treating the dried fibers; contacting the fibers with a 2 wt % aqueous solution of pyrrole at ambient temperature, such that the pyrrole diffuses approximately in a concentrical pattern into an outer ring of the fiber below its surface; contacting the suffused fibers with a 1 wt % aqueous solution of a ferric chloride at ambient temperature to form polypyrrole in situ and then washing the fibers; rinsing the fibers, then soaking the fibers in water; doping the fibers, preferably with an aromatic sulfonic acid; and drying the fibers at low temperature.

Another specific embodiment involves a method of making a low-resistivity fiber suffused with a subsurface layer of polypyrrole. Such method may include the steps of preparing a first aqueous solution of acrylonitrile/vinyl acetate copolymer and sodium thiocyanate; preparing a second aqueous solution of acrylonitrile/vinyl acetate copolymer, sodium thiocyanate and carbon black; metering the two solutions into different sides of a static mixer system so as to form alternating layers of the two solutions across the cross-section of the flowing stream exiting the static mixer; metering the stream into a spinnerette to form smaller individual streams, which then flow into a coagulation bath of a sodium thiocyanate/water solution at 32° F. to form wet fibers; stretching the wet fibers; washing the stretched wet fibers to remove solvents; drying the wet fibers, the wet fibers not being under tension; steam treating the dried fibers; contacting the fibers with a 2 wt % aqueous solution of pyrrole at ambient temperature, such that the pyrrole diffuses approximately in a concentrical pattern into an outer ring of the fiber below its surface; contacting the suffused fibers with a 1 wt % aqueous solution of a ferric chloride and an aromatic sulfonic acid doping agent at ambient temperature to form doped polypyrrole in situ and then washing the fiber; and drying the fibers at low temperature.

In yet another embodiment, the invention is directed to a method of increasing the conductivity of an article. This method has applicability to not only fibers, as discussed elsewhere in this patent, but also other formed polymeric articles such as fabrics, coatings, films, painted layers, plastic sheets, molded articles, and the like. The method includes the steps of coating the surface of the article with a conductive polymer blend to form a conductive coating wherein the conductive polymer blend comprises a film-forming polymer and interspersed conductive particles. The film-forming polymer should be selected for its film-forming or coating properties and not necessarily for its conductive properties. Thus, the film-forming polymer may be nonconductive. The conductive polymer blend should be in solution, in a dispersion in water or a solvent, or at least at a temperature sufficiently high so that the polymer blend is in a liquid state, so that it can be spread over the surface of the article, i.e., formed into a coating. Then, after the conductive polymer blend has sufficiently dried, hardened or cured, the method involves contacting the conductive coating with monomers capable of forming a conductive polymer, such as those described above, e.g., pyrrole, aniline or the like. The monomers should contact the coating for a time sufficient to suffuse the monomers into the conductive coating. Then, the method involves the step of polymerizing the suffused monomers to form an article having a conductive polymer coating with an interpenetrated phase of conductive polymer, e.g., suffused polypyrrole or suffused polyaniline or the like. Depending on the amount of conductive particles and conductive polymer, it is contemplated that the article should have excellent conductive properties with effective thermal and chemical resistance.

DETAILED DESCRIPTION AND PREFERRED EMBODIMENTS

The following discussion relates to additional details of the invention and preferred embodiments of the invention, which is a fiber and method for making a fiber. Preferably, the fiber is a random bicomponent fiber, with both of the components containing a nonconductive fiber-forming polymer component and at least one of the components being a conductive component. Although other "components" may be present, the term "bicomponent" refers to the fiber-forming components in the base fiber.

As discussed above, an important feature of one or more specific embodiments of the invention is the nonconductive component, which preferably includes a standard fiber-forming polymer. The term "fiber-forming polymer" as used herein broadly means any polymer that is capable of forming a continuous filament or preferably, a continuous multifilament tow bundle. The continuous filament or continuous multifilament tow bundle facilitates the conducting of electricity preferably to run virtually continuously over the entire length. A wide variety of synthetic fiber-forming polymers (including copolymers) may be used, such as polyethylene terephthalate, nylon 6, nylon 6,6, cellulose, polypropylene cellulose acetate, polyacrylonitrile and copolymers of polyacrylonitrile. A presently preferred fiber-forming polymer is an polyacrylonitrile copolymer commonly used to manufacture acrylic fiber, particularly a copolymer of acrylonitrile and vinyl acetate. Other classes of useful fiber-forming polymers are modacrylic polymer compositions, aromatic polyesters, aromatic polyamides and polybenzimidazoles.

Another important aspect of the invention involves the electrically conductive particles. The conductive component of the bicomponent fiber preferably includes an intimate mixture of about 15 to 50 wt % conductive carbon particles with the balance composed of one or more standard fiber-forming polymers discussed above. The conductive component should have at least about 15 wt % carbon particles. However, a narrower yet acceptable range is from about 20 wt % to 50 wt %, and, more preferably, about 35 to 50 wt % carbon particles. A number of factors go into deciding the precise amount of carbon particles that should be incorporated, including their conductivity, their average particle size and their effect on the fiber-forming properties of the polymers. The term "electrically conductive particles" or "conductive particles" as used herein means particles having a resistivity of no more than about $10^5$ Ω/square. Preferably, such particles have intrinsic semiconductor properties such that they render normally nonconductive polymers (e.g., polyacrylonitrile) conductive, at least antistatic and preferably highly conductive. Preferably, the conductive particles are carbon or graphite particles, but they may also include materials such as tin oxide, vanadium oxide, silver, gold, or other similar conductive materials. For carbon particles, conductivity differences between individual particles are believed to be primarily resultant from differences in surface area structure and chemisorbed oxygen complexes on the surface. Conductive carbon black particles that may be used with this invention include Vulcan® XC-72 or Black Pearls® 2000, available from Cabot.

The base antistatic bicomponent fiber of this invention, made of at least a nonconductive component and a conductive component, may be approximately circular in cross-section. The base antistatic bicomponent fiber described herein is a "random" bicomponent fiber. A cross-section of the base antistatic random bicomponent fiber may show alternating layers of the conductive component and the nonconductive component. The layers may be oriented roughly laterally across the cross-section, e.g. side-by-side layering. In one specific embodiment, layers of electrically nonconductive polyacrylonitrile polymer alternate in a random fashion throughout the fiber with layers of an electrically conductive mixture of polyacrylonitrile polymer and conductive carbon particles. The base antistatic bicomponent fibers of the invention may generally have an average of two layers in a given cross-section. However, anywhere from one to four layers may also be present. The cross-sectional layers may extend in a continuous manner; however it is preferred that the layers extend discontinuously along the length of the fibers. It is also preferred for the fiber layers to be substantially free of microvoids. "Microvoids" as used herein broadly means weakened spaces in the fiber resulting from water being removed too quickly following the fiber formation from the spinnerette. Fibers free of microvoids are also referred to as "fully collapsed fibers."

Preferably, the base antistatic bicomponent fibers of this invention are made in "tow bundles." The term "low bundles" as used herein means a continuously produced multifilament band having individual filament deniers in the range 0.5 denier/filament up to 30 denier/filament, and total number of such continuously produced filaments in the band from 100 to 2,000,000, with the total denier (calculated by multiplying the denier/filament by the total number of filaments) in the range of 100 up to 2,000,000. The base antistatic tow bundle may be manufactured to have a resistivity of about $10^5$ to $10^8$ ohms per square, or lower. In accordance with certain aspects of the invention, this base antistatic tow bundle may be treated by suffusing a polymerizable material that forms a conductive polymer within the fiber; that is, the polymer is formed "in situ." Examples of such polymerizable materials or monomers include thiophene, aniline, pyrrole and their derivatives. The polymerizable monomer material is suffused into the outer part of the fiber beneath the surface. Preferably, pyrrole monomer is suffused into the layered structure from an aqueous solution such that some pyrrole is present in an outer, essentially concentric part of the fiber, below its surface (although some pyrrole may also be present on the surface). Although unsubstituted pyrrole is the preferred pyrrole monomer, both for the conductivity of the doped polypyrrole and for its reactivity, other pyrrole monomers may also be used, i.e., pyrrole derivatives or "substituted pyrroles," including N-methylpyrrole, 3-methylpyrrole, 3,5-dimethylpyrrole, 2,2'-bipyrrole, and the like, especially N-methylpyrrole. More generally, the pyrrole compound (including derivatives) may be selected from pyrrole, 3-, and 3,4-alkyl and aryl substituted pyrrole, and N-alkyl, and N-aryl pyrrole. Two or more different types of pyrrole compounds may be used to form a conductive copolymer in situ. However, it is preferred that such copolymers contain predominantly pyrrole, e.g., at least 50 mole percent, preferably at least 70 mole percent, and more preferably at least 90 mole percent of pyrrole. It is contemplated that use of a pyrrole derivative, having a lower polymerization reaction rate than pyrrole, may effectively lower the overall polymerization rate.

In addition to pyrrole compounds, it is contemplated that aniline components may also be used. That is, under proper conditions, aniline may form a conductive polymer much like the pyrrole compounds mentioned above. Polymerization of the aniline monomer provides polyaniline in approximately the same way polymerization of pyrrole forms polypyrrole.

Irrespective of the conductive monomer or monomer mix selected, the conductive polymer is preferably created "in situ" by contacting the monomer(s) with which the fiber is already suffused with an oxidizing agent in solution. Preferably, polypyrrole is created in situ by contacting the suffused monomer in the fiber with aqueous ferric chloride as the oxidizing agent.

A polymerization agent, initiator, or promoter is preferably used to initiate polymerization and the monomer to form the highly conductive polymer. Preferably, an oxidizing agent or initiator is utilized to polymerize the monomer material to form the conductive polymer. These oxidizing agents preferably include sodium chlorate, sodium persulfate, potassium permanganate, $Fe_2(SO_4)_3$, $K_3(Fe(CN)_6)$, $H_3PO_4*12\ MoO_3$, $H_3PO_4*12WO$, $Cr\ O_3$, $(NH_4)_2$, $Ce(NO_3)_6$, $Ce(SO_4)_2$, $CuCl_2$, $AgNO_3$, and $FeCl_3$. At least with polymerization of pyrrole, ferric chloride ($FeCl_3$) is a preferred oxidizing agent. It is contemplated that compounds without metallic components, such as nitrites, quinone, peroxides and peracids, may also be used as oxidizing agents. The initiator may be dissolved in a variety of polar organic and inorganic solvents including alcohols, acetonitrile, acetic acid, acetone, amides, ethers, and water, water being preferred.

A great number of oxidants may be suitable for the production of conductive fabrics; however, this is not necessarily the case for aniline. Aniline is known to polymerize and form at least five different forms of polyaniline, most of which are not conductive. At the present time the emeraldine form of polyaniline is the preferred species of polyaniline. As the name implies, the color of this species of polyaniline is green in contrast to the black color of the polypyrrole. Suitable chemical oxidants for the polymerization of aniline include persulfates, particularly ammonium persulfate, but conductive textiles may also be obtained with ferric chloride. Other oxidants form polyaniline films on the surface of the fibers such as, for instance, potassium dichromate and others.

Preferably, the fiber bundle is treated with a doping agent. Doping agents themselves are well known for lowering resistivity of fibers. The doping agent may be preferably applied simultaneously with the polymerization agent, or it may be applied subsequent to the polymerization reaction. More preferably, doped polypyrrole is created in situ by contacting the suffused monomer in the fiber with aqueous ferric chloride as the oxidizing agent and anthraquinone sulfonic acid as the doping agent simultaneously in solution. In a specific embodiment, a dopant anion for the polymer may be supplied in conjunction with an oxidant. For example, a chloride ion (Cl—) resulting from an aqueous $FeCl_3$ solution may serve as the doping agent for the polypyrrole while the $Fe+^{+3}$ cation serves as the oxidant initiator. Alternatively, doping agents may be applied to the fiber after the polymerization reaction, to provide additional resistivity. Such dopant anions may include organic anions, particularly alkyl or aryl sulfonates. The alkyl sulfonates may contain alkyl groups of from 1 to about 18 carbon atoms, and such alkyl groups may be unsubstituted or substituted, e.g., by halogen, such as chlorine or fluorine atoms. The aryl groups may be benzene, naphthalene, anthracene, and the like, and such aryl groups may be unsubstituted or substituted, e.g., by alkyl groups, such as methyl, ethyl, and the like. Other dopant anions which may be employed according to the invention are fluorinated carboxylates, particularly perfluorinated acetates and perfluorinated butyrates. Preferably, an aromatic sulfonic acid(s), most preferably anthraquinone-5-sulfonic acid, is used as the dopant agent to further lower the resistivity of the fiber bundle. The resulting tow bundle will preferably have a resistivity of about $10^2$ to $10^4$ ohms per square.

An important aspect of certain embodiments of the invention is the conductive properties. For example, an important property is "resistivity." Resistivity is usually expressed in ohm-centimeters and relates to the ability of the material to resist passage of electricity. In general, resistivity is defined in accordance with the following:

$$R=\rho l/A$$

where R is the resistance of a uniform conductor, l is its length, A is its cross sectional area, and ρ is its resistivity. Resistivity as applied to the fibers of this invention is expressed in ohms/square, in accordance with the procedure set forth in AATCC Method 76-1995:

$$R=0\times W/D$$

where R is the resistivity in ohms per square, 0 is measured resistance in ohms, W is the width of the specimen, and D is the distance between parallel electrodes; and $$R=2.73(O)\log r_o r_i$$

where R is the resistivity in ohms per square, O is measured resistance in ohms, $r_o$ is the outer electrode radium, and $r_i$ is the inner electrodes radius, for the concentric ring case. Although resistivity in general can also be measured in a number of other ways, the above technique is used herein to measure resistivity of fibers of the invention.

As discussed in detail above, in a preferred aspect, the present invention is directed to fibers. However, in another aspect, the invention is directed broadly to a polymer matrix, such as fabrics, coatings, sheets, painted layers, molded articles, and films made with conductive particles, preferably conductive carbon particles. The same general principles and procedures used to treat fibers may be used in treatment of other articles. For example, a polymer matrix may be subsequently treated to form an interpenetrated network with a conductive polymer. The polymer matrix itself may be either porous or non-porous, although it will typically be non-porous, e.g., a fabric having non-porous fibers. In another aspect, the polymer matrix may be used as a coating for antistatic floor coverings, computer components (e.g., keyboards or printed circuit boards) and antistatic wrappings, for example, antistatic wrappings of electronic equipment or electromagnetic interference shields for computers and other sensitive equipment or instruments.

The polymer matrix broadly includes an interpenetrated network that includes at least two polymer components and conductive particles, preferably carbon particles, interspersed in one or both of the polymer components. The term "interpenetrated polymer network" is defined herein as a two or more component polymer mixture where the polymers are intimately mixed at the molecular level. Preferably, the two or more component polymers are merely blended, with substantially no copolymerization between the two or more polymers. The first polymer is considered to be the "major" component, the second polymer being the "minor" component. As discussed above, the major component may include copolymers, having the carbon particles interspersed therein. The second or "minor" component of the interpenetrated network includes a conductive polymer, preferably polypyrrole, which is preferably formed in situ within the major phase, preferably in electroconductive contact with the conductive particles.

EXAMPLES

The fiber preferably has a chemical resistance which demonstrates a synergistic effect between the interpenetrating network of the conductive polymer and the conductive particles. A series of tests was conducted comparing changes in resistivity in different chemical environments among (1) a conductive fiber tow bundle containing conducting carbon particles but no conductive polymer (Example 1 below); (2) a conductive fiber tow bundle without conducting carbon particles but with a conductive polypyrrole polymer interpenetrated with the fiber (Example 2 below); and (3) a conductive fiber tow bundle containing conducting carbon particles and an interpenetrating network of polypyrrole (Example 3 below). The results of each test are shown in Tables 1, 2, and 3, respectively.

The procedures used for measuring the resistivity for these tests was AATCC 76-1995. According to this method, two parallel or concentric rings electrodes are contacted with the tow bundle. Resistivity is measured with a standard ohm meter capable of measuring values between 1 and 20 million ohms. For low resistance measurements of 1 to $1\times10^4$ ohms, a Fluke 37 multimeter is used with parallel electrodes. For higher resistance measurements of between $1\times10^4$ to $1\times10^{12}$ ohms, a Megaresta surface resistance tester model HT-301 is used with concentric electrodes.

Weak acid and base solutions were prepared to obtain the desired pH levels for testing. In addition, test chemicals were chosen to represent cleaning products typically in contact with flooring. These cleaning products were tested at full strength without dilution and exhibited a broad range of pH levels.

Example 1

A conductive fiber tow bundle containing conducting carbon particles but no conductive polymer was made by preparing two polymer solutions that were fed continuously to a static mixer. A first polymer solution ("Solution A") was prepared from standard fiber forming acrylonitrile/vinyl acetate copolymer ("ANNA") dissolved in aqueous sodium thiocyanate ("NaSCN"), such that the mixture composition was 14.1 wt % ANNA polymer, 39.5 wt % NaSCN, and 46.4 wt % water. The second polymer solution ("Solution B") was prepared from 9.0 wt % ANNA polymer, 38.5 wt % NaSCN, 45.5 wt % water and 7.0 wt % conductive carbon. The conductive carbon type used in this example was Cabot Vulcan® XC-72. The polymer solutions A and B were metered into the two sides of the static mixer so that the ratio of the polymer stream A to the polymer stream B was 80 to 20% by weight. In the mixer, the two streams were partially mixed such that alternating layers of polymer streams A and B were formed longitudinally along the length of the pipe at the exit of the mixer.

The combined stream was then metered with a gear pump through a spinnerette having 20959 holes of 75$\mu$ diameter into a coagulating aqueous bath of 14.7 wt % NaSCN maintained at 1.1° C. Coagulation of the solution exiting from the spinnerette holes formed the individual fibers which have had the alternating layers of solution A and B longitudinally along the fiber.

All the fibers formed from 12 such spinnerettes were combined to make a tow band which was subjected to a first stretch where the fibers were stretched 2.5 times the initial length in an aqueous bath of 6 wt % NaSCN at ambient temperature. The stretched fibers were washed countercurrently by deionized water to remove residual NaSCN solvent. Next, the fibers were subjected to a hot stretching step where the fibers were stretched an additional 5 times the original length for a total stretch of 12.5 times the original length. Then the fibers were dried such that the internal water in the fibers was removed to form a homogenous fiber having no internal bubbles or microvoids. The fibers were then treated with saturated steam at 135° C. A spin finish was applied to the fibers and the fibers were mechanically crimped in a stuffing box type crimper. A final drying step removed residual water from the fibers and the dry tow bundle was packaged. The final tow bundle of Example 1 had 251,508 filaments at 3.0 denier/filament. The resistivity of the tow bundle was 5×105 ohms per square as measured by AATCC 76-1995 discussed above.

TABLE 1

Chemical Resistance of Bicomponent Acrylic Conductive Fibers Without Polypyrrole

| | Resistance Ohms/sqr | | | | | |
|---|---|---|---|---|---|---|
| TIME | 0 | 8 Hrs. | 24 Hrs. | 36 Hrs. | 48 Hrs. | 60 Hrs. |
| pH | | | | | | |
| 3 | $5.30\times10^4$ | $2.79\times10^5$ | $9.80\times10^4$ | $1.41\times10^5$ | $1.38\times10^5$ | $8.60\times10^5$ |
| 5 | $5.30\times10^4$ | $1.48\times10^5$ | $3.15\times10^5$ | $4.76\times10^4$ | $4.68\times10^4$ | $1.43\times10^5$ |
| 9 | $5.30\times10^4$ | $2.11\times10^5$ | $6.70\times10^4$ | — | $4.87\times10^4$ | $2.00\times10^5$ |
| 11 | $5.30\times10^4$ | $9.60\times10^3$ | $5.52\times10^4$ | $1.41\times10^6$ | $2.00\times10^5$ | $2.65\times10^5$ |

TABLE 1-continued

| Chemical Resistance of Bicomponent Acrylic Conductive Fibers Without Polypyrrole | | | | | | |
|---|---|---|---|---|---|---|
| | Resistance Ohms/sqr | | | | | |
| TIME | 0 | 8 Hrs. | 24 Hrs. | 36 Hrs. | 48 Hrs. | 60 Hrs. |
| Test Chemicals | | | | | | |
| TEST A-Betco Corp.-Best Scent Deodorant ® | $1.00 \times 10^3$ | $1.00 \times 10^3$ | $5.65 \times 10^4$ | $8.70 \times 10^3$ | $1.00 \times 10^3$ | $1.20 \times 10^4$ |
| TEST B-Spartan-Shineline Emulsifier Plus Floor Stripper ® | $1.00 \times 10^3$ | $7.60 \times 10^4$ | $3.02 \times 10^4$ | $6.90 \times 10^4$ | $5.69 \times 10^4$ | $1.91 \times 10^5$ |
| TEST C-Foamy Q & A Acid Disinfectant Cleaner ® | $1.00 \times 10^3$ | $1.00 \times 10^3$ | $1.00 \times 10^3$ | $1.00 \times 10^3$ | $1.00 \times 10^3$ | $1.00 \times 10^3$ |
| TEST D-Purex Bleach ® | $1.00 \times 10^3$ | $6.55 \times 10^5$ | $5.81 \times 10^5$ | $1.18 \times 10^7$ | $1.88 \times 10^6$ | $2.79 \times 10^6$ |

Example 2

For comparative test purposes, a conductive fiber tow bundle without conducting carbon particles but with a conductive polypyrrole polymer interpenetrated with the fiber was made. A standard nonconductive textile acrylic fiber tow bundle containing 936,000 filaments at 1.7 denier/filament was treated to form the interpenetrated network of polypyrrole by placing 10 grams of the fiber to be treated in a bath containing 2 wt % aqueous pyrrole at 25° C. for 30 minutes, wherein the fiber to bath weight ratio was 1 to 10. This treatment suffused pyrrole monomer into the outer part of the fiber. The fiber was then removed from the bath and squeezed dry. Next, the fiber was treated in a bath of 1.0 wt % ferric chloride ($FeCl_3$) at 25° C. for 30 minutes. The fiber was then squeezed to damp dryness and washed with the ionized water to remove excess ferric chloride. The washed fiber was treated with 0.5 wt % solution of anthraquinone-5-sulfonic acid at a temperature of 25° C. for 10 minutes. The anthraquinone-5-sulfonic acid served as an effective doping agent for the polypyrrole. After this treatment, the fiber was again squeezed dry and washed with the ionized water. It was then dried for 4 hours at 107.2° C. The resulting fiber had a resistivity of $1 \times 10^3$ ohms/square.

TABLE 2

| Chemical Resistance of Standard Acrylic Fibers Modified with Polypyrrole | | | | | | |
|---|---|---|---|---|---|---|
| | Resistance Ohms/sqr | | | | | |
| TIME | 0 | 8 Hrs. | 24 Hrs. | 36 Hrs. | 48 Hrs. | 60 Hrs. |
| pH | | | | | | |
| 3 | $1.00 \times 10^3$ | $1.00 \times 10^3$ | $1.00 \times 10^3$ | $1.00 \times 10^3$ | $1.00 \times 10^3$ | $1.00 \times 10^3$ |
| 5 | $1.00 \times 10^3$ | $1.00 \times 10^3$ | $1.00 \times 10^3$ | $1.00 \times 10^3$ | $1.00 \times 10^3$ | $1.00 \times 10^3$ |
| 9 | $1.00 \times 10^3$ | $1.00 \times 10^3$ | $1.00 \times 10^3$ | $1.00 \times 10^3$ | $1.00 \times 10^3$ | $1.02 \times 10^4$ |
| 11 | $1.00 \times 10^3$ | $2.67 \times 10^5$ | $3.31 \times 10^5$ | $2.41 \times 10^5$ | $6.04 \times 10^5$ | $2.01 \times 10^5$ |
| TEST CHEMICALS | | | | | | |
| TEST A-Betco Corp.-Best Scent Deodorant ® | $1.00 \times 10^3$ | $1.48 \times 10^4$ | $5.35 \times 10^4$ | $1.13 \times 10^4$ | $1.10 \times 10^4$ | $1.47 \times 10^4$ |
| TEST B-Spartan-Shineline Emulsifier Plus Floor Stripper ® | $1.00 \times 10^3$ | $4.21 \times 10^5$ | $6.59 \times 10^6$ | $4.29 \times 10^5$ | $9.80 \times 10^5$ | $2.28 \times 10^6$ |
| TEST C-Foamy Q & A Acid Disinfectant Cleaner ® | $1.00 \times 10^3$ | $1.00 \times 10^3$ | $1.00 \times 10^3$ | $1.00 \times 10^3$ | $1.00 \times 10^3$ | $1.00 \times 10^3$ |
| TEST D-Purex Bleach ® | $1.00 \times 10^3$ | $3.76 \times 10^8$ | $7.49 \times 10^9$ | $9.50 \times 10^6$ | $1.24 \times 10^8$ | $1.00 \times 10^{11}$ |

Example 3

A conductive fiber tow bundle containing both conducting carbon particles and an interpenetrated network of polypyrrole was made by taking the fiber produced by Example 1 and treated with additional steps according to the procedure of Example 2. The resulting fiber tow bundle had a significantly reduced resistivity of $1\times10^3$ ohms/square.

TABLE 3

Chemical Resistance of Bicomponent Acrylic Conductive Fibers Modified With Polypyrrole

| | Resistance Ohms/sqr | | | | | |
|---|---|---|---|---|---|---|
| TIME | 0 | 8 Hrs. | 24 Hrs. | 36 Hrs. | 48 Hrs. | 60 Hrs. |
| pH | | | | | | |
| 3 | $1.00 \times 10^3$ | $1.00 \times 10^3$ | $1.00 \times 10^3$ | $1.00 \times 10^3$ | $1.00 \times 10^3$ | $1.00 \times 10^3$ |
| 5 | $1.00 \times 10^3$ | $1.00 \times 10^3$ | $1.00 \times 10^3$ | $1.00 \times 10^3$ | $1.00 \times 10^3$ | $1.00 \times 10^3$ |
| 9 | $1.04 \times 10^4$ | $1.00 \times 10^3$ | $1.00 \times 10^3$ | $1.00 \times 10^3$ | $1.00 \times 10^3$ | $1.02 \times 10^4$ |
| 11 | $1.00 \times 10^3$ | $9.60 \times 10^3$ | $2.64 \times 10^4$ | $8.40 \times 10^4$ | $1.99 \times 10^4$ | $2.76 \times 10^4$ |
| Test Chemicals | | | | | | |
| TEST A-Betco Corp.-Best Scent Deodorant ® | $1.00 \times 10^3$ | $1.00 \times 10^3$ | $5.65 \times 10^4$ | $8.70 \times 10^3$ | $1.00 \times 10^3$ | $1.20 \times 10^4$ |
| TEST B-Spartan-Shineline Emulsifier Plus Floor Stripper ® | $1.00 \times 10^3$ | $7.60 \times 10^4$ | $3.02 \times 10^4$ | $6.09 \times 10^4$ | $5.69 \times 10^4$ | $1.91 \times 10^4$ |
| TEST C-Foamy Q & A Acid Disinfectant Cleaner ® | $1.00 \times 10^3$ | $1.00 \times 10^3$ | $1.00 \times 10^3$ | $1.00 \times 10^3$ | $1.00 \times 10^3$ | $1.00 \times 10^3$ |
| TEST D-Purex Bleach ® | $1.00 \times 10^3$ | $6.55 \times 10^4$ | $5.81 \times 10^5$ | $1.18 \times 10^7$ | $1.88 \times 10^6$ | $2.79 \times 10^6$ |

A further feature of the present invention is that the fiber exhibits unexpected thermal resistance. The relatively unchanging resistance of the fibers tested demonstrated a synergistic effect between the interpenetrating network of the conductive polymer and the conductive particles.

For the thermal stability test, a specimen of 6" fiber tow is cut and the resistance $R_0$ is determined. The specimen is then hung in a constant temperature oven with forced air circulation for a predetermined amount of time. The specimen is then removed from the oven and the area resistance is measured again, $R_x$. The specimen is returned to the oven, after which this procedure is repeated until the conclusion of the test.

Tests comparing the thermal resistance of the test fibers produced in Examples 1, 2, and 3 to changes in electrical resistivity were also conducted. The results of these tests are shown in Tables 4, 5, and 6, respectively. Some of the selected test temperatures exceed normal ambient conditions that the fibers would typically encounter but were chosen to simulate an accelerated aging test.

TABLE 4

Thermal Resistance of Bicomponent Acrylic Conductive Fibers Without Polypyrrole

| Temperature 150° F. | Resistivity ohms/sqr | Temperature 230° F. | Resistivity ohms/sqr | Temperature 330° F. | Resistivity ohms/sqr |
|---|---|---|---|---|---|
| TIME | | | | | |
| 0 | $3.20 \times 10^4$ | 0 | $3.20 \times 10^4$ | 0 | $3.20 \times 10^4$ |
| 8 Hrs. | $1.43 \times 10^5$ | 30 min. | $1.18 \times 10^4$ | 30 min. | $2.91 \times 10^4$ |
| 1 Day | $1.01 \times 10^5$ | 60 min. | $1.26 \times 10^4$ | 60 min. | $1.48 \times 10^4$ |
| 2 Days | $1.51 \times 10^5$ | 75 min. | $1.53 \times 10^4$ | 75 min. | $1.80 \times 10^4$ |
| 3 Days | $1.80 \times 10^5$ | 90 min. | $1.86 \times 10^4$ | 90 min. | $1.07 \times 10^4$ |
| 4 Days | $0.99 \times 10^5$ | 105 min. | $1.92 \times 10^4$ | 105 min. | $1.21 \times 10^4$ |
| 5 Days | $1.43 \times 10^5$ | 120 min. | $5.22 \times 10^4$ | 120 min. | $1.08 \times 10^4$ |
| 6 Days | $1.52 \times 10^5$ | 135 min. | $4.87 \times 10^5$ | 135 min. | $2.51 \times 10^4$ |
| 7 Days | $1.97 \times 10^5$ | 150 min. | $2.59 \times 10^4$ | 150 min. | $1.50 \times 10^4$ |
| 8 Days | $1.40 \times 10^5$ | 165 min. | $3.81 \times 10^4$ | 165 min. | $1.63 \times 10^4$ |
| 9 Days | $1.54 \times 10^5$ | 180 min. | $3.49 \times 10^4$ | 180 min. | $1.25 \times 10^4$ |

TABLE 5

Thermal Resistance of Standard Acrylic Fibers Modified With Polypyrrole

| Temperature 150° F. | Resistivity ohms/sqr | Temperature 230° F. | Resistivity ohms/sqr | Temperature 330° F. | Resistivity ohms/sqr |
|---|---|---|---|---|---|
| TIME | | | | | |
| 0 | $1.00 \times 10^3$ | 0 | $1.00 \times 10^3$ | 0 | $1.00 \times 10^3$ |
| 8 Hrs. | $1.00 \times 10^3$ | 30 min. | $1.00 \times 10^3$ | 30 min. | $1.00 \times 10^3$ |
| 1 Day | $1.00 \times 10^3$ | 60 min. | $1.00 \times 10^3$ | 60 min. | $6.62 \times 10^4$ |
| 2 Days | $1.00 \times 10^3$ | 75 min. | $1.00 \times 10^3$ | 75 min. | $1.32 \times 10^5$ |
| 3 Days | $1.00 \times 10^3$ | 90 min. | $1.00 \times 10^3$ | 90 min. | $4.65 \times 10^5$ |
| 4 Days | $1.00 \times 10^3$ | 105 min. | $1.00 \times 10^3$ | 105 min | $9.19 \times 10^5$ |
| 5 Days | $1.00 \times 10^3$ | 120 min. | $1.00 \times 10^3$ | 120 min. | $1.29 \times 10^6$ |
| 6 Days | $1.00 \times 10^3$ | 135 min. | $1.00 \times 10^3$ | 135 min. | $8.51 \times 10^6$ |
| 7 Days | $1.00 \times 10^3$ | 150 min. | $1.00 \times 10^3$ | 150 min. | $6.02 \times 10^6$ |
| 8 Days | $1.00 \times 10^3$ | 165 min. | $1.00 \times 10^3$ | 165 min. | $8.14 \times 10^6$ |
| 9 Days | $1.00 \times 10^3$ | 180 min. | $1.00 \times 10^3$ | 180 min. | $1.79 \times 10^7$ |
| | | 4 hrs. | $1.00 \times 10^3$ | | |
| | | 5 hrs. | $1.00 \times 10^3$ | | |
| | | 6 hrs. | $1.00 \times 10^3$ | | |
| | | 7 hrs. | $1.00 \times 10^3$ | | |
| | | 8 hrs. | $1.00 \times 10^3$ | | |
| | | 9 hrs. | $1.07 \times 10^4$ | | |
| | | 10 hrs. | $1.00 \times 10^3$ | | |
| | | 11 hrs. | $9.9 \times 10^3$ | | |
| | | 12 hrs. | $2.28 \times 10^4$ | | |
| | | 13 hrs. | $2.04 \times 10^4$ | | |

TABLE 6

Thermal Resistance of Bicomponent Acrylic Conductive Fibers Modified with Polypyrrole

| Temperature 150° F. | Resistivity ohms/sqr | Temperature 230° F. | Resistivity ohms/sqr | Temperature 330° F. | Resistivity ohms/sqr |
|---|---|---|---|---|---|
| TIME | | | | | |
| 0 | $1.00 \times 10^3$ | 0 | $1.00 \times 10^3$ | 0 | $1.00 \times 10^3$ |
| 8 Hrs. | $1.00 \times 10^3$ | 30 min. | $1.00 \times 10^3$ | 30 min. | $1.00 \times 10^3$ |
| 1 Day | $1.00 \times 10^3$ | 60 min. | $1.00 \times 10^3$ | 60 min. | $1.00 \times 10^3$ |
| 2 Days | $1.00 \times 10^3$ | 75 min. | $1.00 \times 10^3$ | 75 min. | $1.00 \times 10^3$ |
| 3 Days | $1.00 \times 10^3$ | 90 min. | $1.00 \times 10^3$ | 90 min. | $8.30 \times 10^3$ |
| 4 Days | $1.00 \times 10^3$ | 105 min. | $1.00 \times 10^3$ | 105 min. | $8.00 \times 10^3$ |
| 5 Days | $1.00 \times 10^3$ | 120 min. | $1.00 \times 10^3$ | 120 min. | $1.00 \times 10^3$ |
| 6 Days | $1.00 \times 10^3$ | 135 min. | $1.00 \times 10^3$ | 135 min. | $1.00 \times 10^3$ |
| 7 Days | $1.00 \times 10^3$ | 150 min. | $1.00 \times 10^3$ | 150 min. | $1.00 \times 10^3$ |
| 8 Days | $1.00 \times 10^3$ | 165 min. | $1.00 \times 10^3$ | 165 min. | $1.43 \times 10^4$ |
| 9 Days | $1.00 \times 10^3$ | 180 min. | $1.00 \times 10^3$ | 180 min. | $1.00 \times 10^3$ |
| | | 4 hrs. | $1.00 \times 10^3$ | 4 hrs. | $1.25 \times 10^4$ |
| | | 5 hrs. | $1.00 \times 10^3$ | 5 hrs. | $1.56 \times 10^4$ |
| | | 6 hrs. | $1.00 \times 10^3$ | 6 hrs. | $1.00 \times 10^3$ |
| | | 7 hrs. | $1.00 \times 10^3$ | 7 hrs. | $1.00 \times 10^3$ |
| | | 8 hrs. | $1.00 \times 10^3$ | 8 hrs. | $1.08 \times 10^4$ |
| | | 9 hrs. | $1.00 \times 10^3$ | 9 hrs. | $2.33 \times 10^4$ |
| | | 10 hrs. | $1.00 \times 10^3$ | 10 hrs. | $1.71 \times 10^4$ |
| | | 11 hrs. | $8.10 \times 10^3$ | 11 hrs. | $1.24 \times 10^4$ |
| | | 12 hrs. | $1.16 \times 10^4$ | 12 hrs. | $2.60 \times 10^4$ |
| | | 13 hrs. | $9.00 \times 10^3$ | 13 hrs. | $1.00 \times 10^3$ |

Laundering durability tests were also performed on the fibers made according to the procedures in Example 2 and Example 3. The laundering durability tests were made according to AATCC Test Method 61-1984. The resistivities of the laundered tow bundles were then measured according to AATCC 76-1995. The results of these tests were that the bicomponent conductive acrylic fiber with polypyrrole and carbon particles made according to Example 3 above did not show any increase in resistivity up to 75 launderings. In contrast, the conductive acrylic fiber with polypyrrole, but without carbon particles, made according to Example 2 above, showed an increase in resistivity after 40 launderings.

These laundering durability tests and the series of tests as shown in Tables 1–6 illustrate the low resistivity of the fiber of the invention formed in Example 3 and demonstrates the synergistic effect between the interpenetrating network of conductive polymer and the conductive particles.

Example 4

For comparative test purposes, a second conductive fiber tow bundle made without conducting carbon particles but with a conductive polypyrrole polymer interpenetrated with the fiber was made. A standard nonconductive textile acrylic fiber tow bundle containing 936,000 filaments at 1.7 denier/filament was treated to form the interpenetrated network of polypyrrole by placing 10 grams of the fiber to be treated in a bath containing 2 wt % pyrrole bath at 25° C. for 30 minutes, wherein the fiber to bath weight ratio was 1 to 10. This treatment suffused pyrrole monomer into the outer part of the fiber. The fiber was then removed from the bath and squeezed dry. Next, the fiber was treated in a bath of 1.0 wt % ferric chloride ($FeCl_3$) and 0.5 wt % solution of anthraquinone-5-sulfonic acid at 25° C. for 30 minutes. The anthraquinone-5-sulfonic acid served as an effective doping agent for the polypyrrole. After this treatment, the fiber was squeezed dry and washed with deionized water. It was then dried for 4 hours at 107.2° C. The resulting fiber had a resistivity of $1\times10^3$ ohms/square.

Example 5

A conductive fiber tow bundle containing both conducting carbon particles and an interpenetrated network of polypyrrole was made by taking the fiber produced by Example 1 and treated with additional steps according to the procedure of Example 4 The resulting fiber tow bundle had a significantly reduced resistivity of $1\times10^3$ ohms/square.

Tow samples from Examples 4 and 5 were tested for thermal stability; results are shown in Table 7.

TABLE 7

Test Conditions: 330° F.

| DAYS | Example 4 | Examples |
|---|---|---|
| 0 | $1.7 \times 10^3$ | $1.5 \times 10^3$ |
| 2 | $1 \times 10^{12}$ | $5.0 \times 10^3$ |
| 4 | | $7.0 \times 10^3$ |
| 7 | | $6.7 \times 10^3$ |
| 10 | | $4.7 \times 10^3$ |
| 12 | | $5.3 \times 10^3$ |

While the invention has been described above with reference to certain specific examples and embodiments, a person skilled in the art will recognize many variations from the examples and embodiments based on the information in this patent, without departing from the overall invention. Accordingly, the claims below are intended to cover all changes and modifications of the invention which provide similar advantages and benefits and do not depart from the spirit of the invention.

What is claimed is:

1. A method of making a conductive fiber, comprising the steps of:

(a) forming a polymeric fiber, said fiber including a conductive component having at least about 15 wt % electrically conductive particles;

(b) contacting the formed polymeric fiber with monomers of a conductive polymer for a time sufficient to suffuse the monomers into the fiber; and (c) polymerizing the monomers to form a fiber with an interpenetrating conductive polymer phase comprising the conductive polymer.

2. The method of making a conductive fiber of claim 1, wherein the polymeric fiber is an acrylic fiber and the conductive particles are conductive carbon particles.

3. The method of making a conductive fiber of claim 1, wherein the polymeric fiber is an acrylic fiber and the conductive particles are conductive tin oxide coated titanium dioxide particles.

4. The method of making a conductive fiber of claim 1, wherein the conductive polymer is polypyrrole, and the conductive monomer is pyrrole.

5. The method of making a conductive fiber of claim 1, wherein the polymeric fiber is an acrylic fiber and the conductive particles are conductive carbon particles, including the steps of:

(a) preparing a first aqueous solution of acrylonitrile/vinyl acetate copolymer and sodium thiocyanate;

(b) preparing a second aqueous solution of acrylonitrile/vinyl acetate copolymer, sodium thiocyanate and carbon black;

(c) combining the two solutions so as to form a flowing stream with alternating layers of the two solutions;

(d) metering the stream into a spinnerette to form smaller individual streams;

(e) directing the small streams into a coagulation bath comprising sodium thiocyanate to form wet fibers;

(f) washing the wet fibers to remove any solvents present, stretching the wet fibers, and drying the resulting stretched fibers; and (g) stream treating the wet fibers.

6. The method of making a conductive fiber of claim 1, wherein the polymeric fiber is an acrylic fiber and the conductive particles are conductive carbon particles, and the interpenetrating conductive polymer phase is formed by:

(a) contacting the conductive fibers with an aqueous solution of pyrrole monomer, such that the pyrrole diffuses concentrically into an outer ring of the fiber below its surface;

(b) contacting the suffused fibers with a solution containing an oxidizing agent to form polypyrrole in situ; and (c) doping the fibers with an aromatic sulfonic acid.

7. The method of making a conductive fiber of claim 6, wherein the oxidizing agent is ferric chloride, and the doping agent is anthraquinone sulfonic acid.

* * * * *